US006962211B2

(12) United States Patent
Daubner et al.

(10) Patent No.: US 6,962,211 B2
(45) Date of Patent: Nov. 8, 2005

(54) VIBRATION-DECOUPLING ARRANGEMENT FOR SUPPORTING A PERCUSSION UNIT IN A HAND-HELD PERCUSSION POWER TOOL

(75) Inventors: Christian Daubner, Mammendorf (DE); Hubert Daxenberger, Herrsching (DE); Erwin Manschitz, Germering (DE); Ralph Neuhauser, Augsburg (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/718,180

(22) Filed: Nov. 20, 2003

(65) Prior Publication Data

US 2004/0154813 A1 Aug. 12, 2004

(30) Foreign Application Priority Data

Nov. 22, 2002 (DE) ..... 102 55 162

(51) Int. Cl.[7] ..... B25D 17/00
(52) U.S. Cl. ..... 173/162.2; 173/162.1
(58) Field of Search ..... 173/162, 162.1, 173/162.2, 177, 143; 81/177.1; 408/143

(56) References Cited

U.S. PATENT DOCUMENTS 1,597,245 A * 8/1926 Prellwitz ..... 173/162.2
3,824,417 A * 7/1974 Moores, Jr. ..... 310/51
4,282,938 A * 8/1981 Minamidate ..... 173/162.2
4,478,293 A * 10/1984 Weilenmann et al. .... 173/162.2
4,711,308 A * 12/1987 Blaas et al. ..... 173/162.2
4,800,965 A * 1/1989 Keller ..... 173/162.2
5,025,870 A 6/1991 Gantner

FOREIGN PATENT DOCUMENTS

| | | |
|---|---|---|
| DE | 0109122 | 9/2001 |
| EP | 0849492 | 6/1998 |
| EP | 0865134 | 9/1998 |
| WO | 2083369 | 10/2002 |

* cited by examiner

*Primary Examiner*—Louis K. Huynh
*Assistant Examiner*—Chukwurah Nathaniel
(74) *Attorney, Agent, or Firm*—Abelman, Frayne & Schwab

(57) ABSTRACT

A vibration-decoupling arrangement for supporting a percussion unit (2) in a hand-held percussion power tool includes a spring (4) arranged between the percussion unit (2) and a tool housing (3) and preloaded against an engagement point (P) in the housing (3) for preventing vibrations of the percussion unit (2) from being transmitted to the housing (3), and two axially spaced, flexurally deformable, articulated arms (5*a*, 5*b*) secured in the housing (3) for supporting the percussion unit (2) in the housing (3), with the arms (5*a*, 5*b*) being secured in the housing (3) with a possibility of a limited axial displacement and without any slip motion relative to the housing.

6 Claims, 1 Drawing Sheet

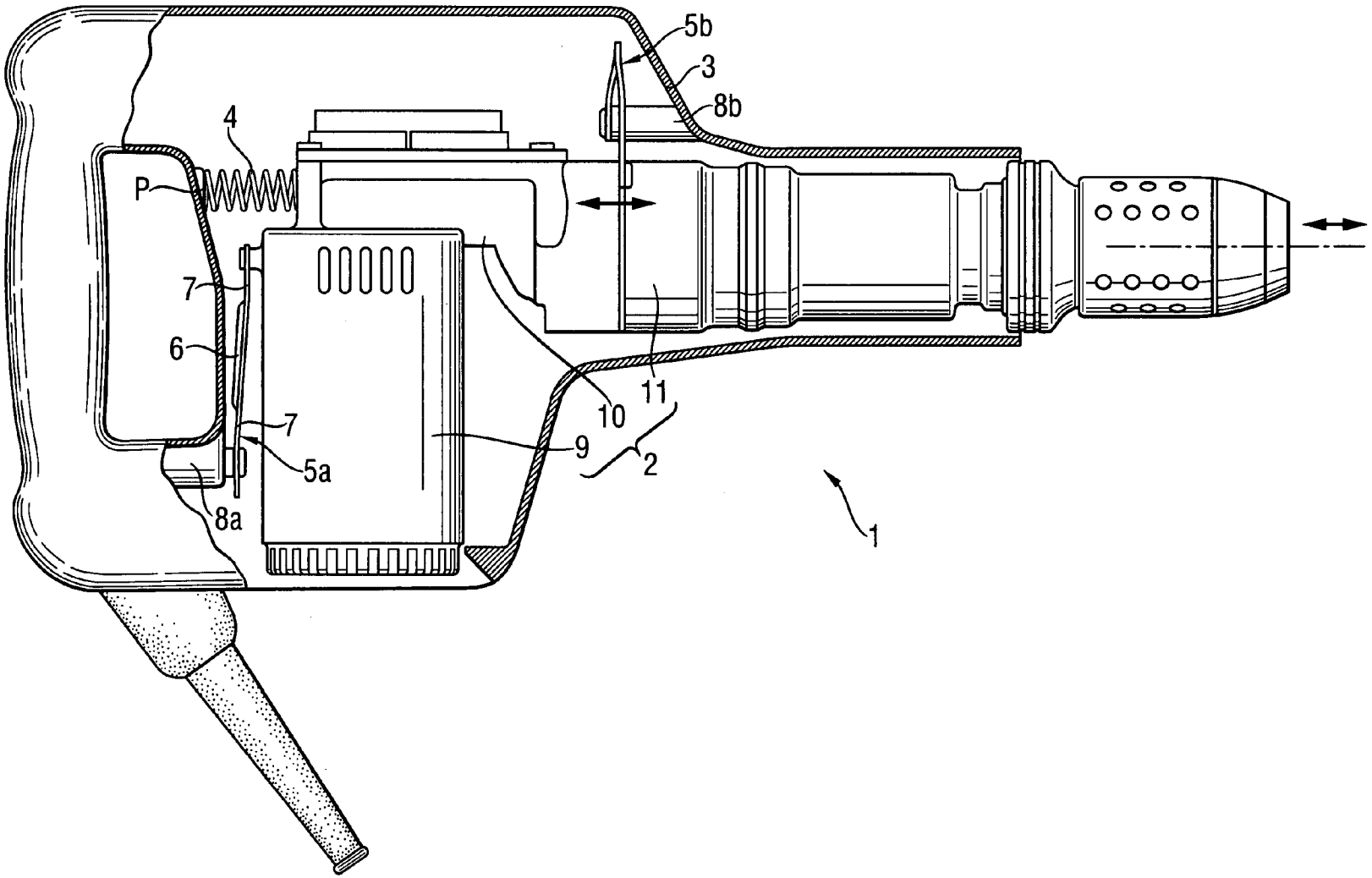
1
2
3
4
5a
5b
6
7
7
8a
8b
9
10
11
P

VIBRATION-DECOUPLING ARRANGEMENT FOR SUPPORTING A PERCUSSION UNIT IN A HAND-HELD PERCUSSION POWER TOOL

BACKGROUND OF THE INVENTION

1. Field of the Invention

The present invention relates to a hand-held percussion power tool, in particular to a hand-held chisel hammer and, more specifically, to a vibration-decoupling arrangement for supporting a percussion unit in the tool housing.

2. Description of the Prior Art

In hand-held percussion power tools, it is very important to be able to isolate the axial percussion load applied to the tool from the tool housing. In particular, in high-power hand-held power tools with power above 1,000 W, the percussion mechanisms have an axial percussion path in a range of several mm. In such tools, dependent on a different spatial orientation of a tool in space in accordance with the direction in which the work is effected, it is important to provide for a different preload of the percussion mechanism in the tool housing, using the gravity force.

European Publication EP 837756 discloses a hand-held percussion power tool in which the percussion unit is preloaded against the housing exclusively by a flexural parallelogram joint formed of leaf springs. The strong leaf spring, which are required for limiting the axial position of the percussion unit at a different spatial work orientation in a space, transmit strong vibrations to different points of the housing, inducing harmful additional lateral oscillating torques.

German Publication DE 2820125 discloses a hand-held power tool in which the percussion mechanism is supported against the tool housing by an axially extending, spiral compression spring.

German Publication De 3405922 discloses a hand-held power tool in which the percussion unit is supported against the housing by an axially extending helical compression spring and with a possibility of axial displacement which is limited by rubber rings.

U.S. Pat. No. 5,025,870 discloses a percussion hand-held power tool with a vibration-decoupled housing and including a parallelogram joint formed of two axially spaced articulated arms supported in slide bearings with a possibility of a limited pivotal movement, and a helical compression spring extending at an angle to the housing axis and preloaded against oscillation center in the housing, whereby lateral oscillation torques are prevented. However, the slide bearings of the tool have a high wear because of usual dust accumulation.

Accordingly, an object to the present invention is to provide substantially wear-free vibration-decoupled percussion unit for a percussion hand-held power tool.

SUMMARY OF THE INVENTION

This and other objects of the present invention, which will become apparent hereinafter, are achieved by providing a vibration-decoupling arrangement for supporting a percussion unit in a housing of a power tool and including a spring arranged between the percussion unit and al tool housing and preloaded against an engagement point in the housing for preventing vibrations of the percussion unit from being transmitted to the housing, and axial guide means for supporting the percussion unit in the housing and including two axially spaced flexurally deformable, articulated arms secured in the housing with a possibility of a limited axial displacement and without any slip motion relative to the housing.

During relative large displacements of about 10 mm which lead at different orientations of the power tool to a different preloading of the percussion unit, the flexurally deformable articulated arms, which support the percussion unit, prevent, at a slip motion-free and, thus, at substantially wear-free guidance, harmful lateral oscillating torques.

Advantageously, the two axially spaced, articulated arms extend parallel to each other, forming a stress-free parallelogram guide.

Advantageously, at least one of the articulated arms has a deflection-resistant middle section and two, elastically deformable, foil end sections. Thereby, during the deflection in the oscillation direction, deflection resistance in the transverse or lateral direction is obtained, which prevents oscillation of the percussion unit in the transverse direction.

Advantageously, the middle section of the at least one arm is provided with additional reinforcing elements. Thereby, acoustically harmful, parasitic, flexural modes and torsional oscillations along the articulated arm are substantially eliminated.

Advantageously, the two articulated arms are oriented, with respect to their radial extent, in opposite directions. Thereby, at different space orientations of the tool, at least one of the arms is subjected to a tensile load along its radial extent under the weight of the percussion unit, with the other arm being relieved. This reliably prevents bulges along the articulated arm, insuring high stability.

Advantageously, the spring is formed as a helical or spiral compression spring, whereby a long-lasting, space-saving spring with an adequate spring constant is provided.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

Single FIGURE of the drawings shows a partially cross-sectional view of a hand-held power tool with a vibration-decoupled percussion unit according to the present invention.

DETAILED DESCRIPTION OF THE PREFERRED EMBODIMENTS

A hand-held percussion power tool 1, which is shown in the drawing, represents a chisel hammer and includes a percussion unit 2 located in a housing 3, a spring 4 arranged between the percussion unit 2 and the housing 3, preloaded against an engagement point P in the housing 3, and formed as a helical compression spring, and axial guide means for supporting the percussion unit 2 and formed of two axially spaced, articulated arms 5*a*, 5*b* arranged in the housing 3 with a possibility of limited axial displacement. The articulated arms 5*a*, 5*b* extend parallel to each other and are oriented, with respect to their radial extent, in opposite directions. The two articulated arms 5*a*, 5*b* are formed of steel and are axially flexurally deformable. The handle-side articulated arm 5*a* has a deflection resistant middle section with additional reinforcing elements 6 and two flat, elastically deformable, end foil section 7. The two articulated arms 5*a*, 5*b* are connected to the housing 3 by respective axially extending members 8*a*, 8*b* and are directly connected with the percussion mechanism without any slip motion relative to the percussion mechanism 2 and to the housing 3. The percussion unit 2 includes an electric motor 9, a gear mechanism 10, and a percussion mechanism 11.

Though the present invention was shown and described with references to the preferred embodiments such are merely illustrative of the present invention and are not to be construed as a limitation thereof and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A vibration-decoupling arrangement for supporting a percussion unit in a hand-held percussion power tool, the arrangement comprising a spring (4) arranged between the percussion unit (2) and a tool housing (3) and preloaded against an engagement point (P) in the housing (3) for preventing vibrations of the percussion unit (2) from being transmitted to the housing (3), and axial guide means for supporting the percussion unit (2) in the housing (3) for a limited axial displacement therein and including two axially spaced, flexurally deformable, articulated arms (5*a*, 5*b*) secured in the housing (3) with a possibility of a limited axial displacement and without slip motion relative to the housing (3), wherein the articulated arms (5*a*, 5*b*) are directly secured to the percussion unit (2) without any slip motion relative thereto.

2. An arrangement according to claim 1, wherein the two articulated arms (5*a*, 5*b*) extent parallel to each other.

3. An arrangement according to claim 1, wherein at least one of the articulated arms (5*a*) has a deflection-resistant middle section and two, elastically deformable, foil end sections (7).

4. An arrangement according to claim 3, wherein the middle section has, additionally, reinforcing means (6).

5. An arrangement according to claim 1, wherein the two articulated arms (5*a*, 5*b*) are oriented in opposite direction with respect to a radial extent thereof.

6. An arrangement according to claim 1, where the spring (4) is formed as a helical compression spring.

* * * * *